United States Patent [19]

Hubbard

[11] 4,011,898

[45] Mar. 15, 1977

[54] WALLET-BAG

[75] Inventor: Kenneth L. Hubbard, Philadelphia, Pa.

[73] Assignee: Urbane Habitats, Philadelphia, Pa.

[22] Filed: May 21, 1976

[21] Appl. No.: 688,691

[52] U.S. Cl. ..... 150/35; 150/1.7; 150/33

[51] Int. Cl.[2] ..... A45C 3/04

[58] Field of Search ..... 150/1.7, 28 R, 33, 35

[56] References Cited

UNITED STATES PATENTS

| | | | |
|---|---|---|---|
| 2,682,290 | 6/1954 | Ditlea | 150/1.7 |
| 3,830,348 | 8/1974 | Ohyama | 150/1.7 X |

*Primary Examiner*—Donald F. Norton
*Attorney, Agent, or Firm*—Smith, Harding, Earley & Follmer

[57] ABSTRACT

A device comprising a combined wallet, shopping bag, and over-the-shoulder purse for carrying miscellaneous articles includes a vinyl sheet having two half portions connected together along a central crease line, a zipper along the borders of the half portions for connecting the two half portions together when the latter are folded over on the central crease line, a zippered pocket opening in each of the half portions of the vinyl sheet, a foldable cloth bag, for example of nylon or acetate, having a bottom sewn to the vinyl sheet with the sidewalls extending substantially from the edges of the vinyl sheet, the bag being foldable and containable within the vinyl sheet when the half portions thereof are folded over and held together by being zippered along their borders, the vinyl sheet forming the interior bottom portion of the bag when the latter is pulled inside-out, and a pair of foldable handle straps stitched to the outside of the bag sidewalls adjacent the top edges thereof for carrying the device as a shopping bag. The device further includes a shoulder strap that is suspended from loops sewn to the outside surface of the bag sidewalls at a selected distance from the top edge of the bag such that upon folding the bag inwardly down to the level of the shoulder strap, pulling the shoulder strap collapses the bag sidewalls to close the top of the bag, the shoulder strap then being slidable over the shoulder for carrying the device as an over-the-shoulder purse.

In one embodiment the handle straps for hand carrying the bag are arranged to provide several of the loops for suspending the shoulder strap.

In another embodiment loops separate from the handle straps are provided for suspending the shoulder strap to the sidewalls of the bag.

In still another embodiment the means for carrying and closing the bag comprises a cord interlaced through eyelets that are arranged around the periphery of the bag adjacent the top thereof. Pulling the cord collapses the sidewalls of the bag to close the top. When evenly pulled to both sides of the bag, the loops of the cord enable the bag to be carried by hand as a shopping bag. When pulled to one side only, the single loop of the cord enables the bag to be carried over the shoulder as a purse.

10 Claims, 19 Drawing Figures

WALLET-BAG

BACKGROUND OF THE INVENTION

1. Field of the Invention

This invention relates to containers such as wallets, bags and purses that are used for carrying miscellaneous personal articles including money.

2. Description of the Prior Art

Heretofore many forms of such containers have been proposed for carrying personal belongings and money while traveling. Thus, small bags closed with a drawstring have been provided for carrying money. Other containers such as handbags, purses, pocketbooks or wallets have also been used to carry money and other small objects. Various types of folding pocketbooks have been provided containing compartments for coins, photographs, cards and keys. Such pocketbooks often are provided with a snap or zipper fastener.

The structure of all such prior art containers or devices, however, has been such as to be restrictive of the use of the device to a limited purpose or to limited purposes that have precluded the selective use of the same device as a wallet, shopping bag and over-the-shoulder purse. Thus, no known wallet small enough to be carried in a pocket has been convertible for serving the purpose also of a shopping bag and over-the-shoulder purse.

SUMMARY OF THE INVENTION

Among the objects of the present invention is the provision of a container that is readily convertible to serve the multiple purposes of a wallet, a hand or shopping bag or purse, and an over-the-shoulder purse for carrying miscellaneous personal belongings and other small articles including money.

In accomplishing these and other objects, the combined wallet, hand or shopping bag, and over-the-shoulder purse of the present invention includes a vinyl sheet having two half portions connected together along a central crease line. A zipper is provided along the borders of the vinyl sheet half portions for connecting the two half portions together when folded over the central crease line. A zippered pocket opening is provided in each half portion of the vinyl sheet. These zippered pocket openings are accessible when the two half portions are folded over on the central crease line. A nylon, acetate or other suitable fabric bag is also provided. The bottom of the bag is sewed to the vinyl sheet, with sidewalls extending therefrom, and is foldable and containable within the vinyl sheet when the latter is zippered along its borders. A pair of foldable straps or handles are mounted on the top of the bag sidewalls. The vinyl sheet forms the interior bottom portion of the bag when opened into operative position.

In operation, with the bag folded and contained within the vinyl sheet and the latter folded over on the central crease line and zippered along its borders, the device of the present invention is usable as a wallet having two zippered pockets. When the device is to be used as a hand or shopping bag, the border zipper of the wallet is unzipped, the sidewalls of the bag are spread outwardly, and the bag is pulled inside-out so that the wallet becomes the inside bottom of the bag. The bag bottom forms the interior of the wallet pocket, and the wallet itself forms a strong, reinforced inside bottom of the bag.

The device of the present invention also includes a shoulder strap or belt loop that is mounted on the outer surface of the bag sidewalls. This shoulder strap is suspended from loops which are sewn to the outside surface of the bag sidewalls at a selected distance from the top of the bag. The top portion of the bag may be folded inwardly down to the level of the shoulder strap, whereby when one end of the shoulder strap is pulled away from the sidewalls to collapse the latter, the top of the bag is neatly closed. The open end of the shoulder strap is then adaptable to slide over the shoulder of a person for wearing the device as an over-the-shoulder purse.

In one embodiment of the invention the straps or handles for hand carrying the bag provide several of the loops for suspending the shoulder strap on the outer surface of the big sidewalls. Thus, these straps perform a dual function of providing a strap or handle for a hand-carried shopping bag, and loops for suspending the shoulder strap for an over-the-shoulder-carried purse.

In another embodiment of the invention loops separate from the hand-carry straps are provided for suspending the shoulder strap to the sidewalls of the bag.

In still another embodiment of the invention, the straps or handles for carrying the bag are not sewn to the bag, nor are loops provided on the bag sidewalls for suspending the shoulder strap. Instead a number of eyelets or grommets are provided in a selected upper portion of the sidewalls of the bag and a suitably strong cord is interlaced through the eyelets for enabling the bag either to be hand or shoulder carried. With this embodiment, as in those previously described, the top of the bag may be folded inwardly down to the level of the eyelets and the cord, and the cord may be pulled to collapse the sidewall of the bag and to neatly close the top of the bag. The open end of the cord is then slidable over the shoulder of a person desiring to wear the bag.

BRIEF DESCRIPTION OF THE DRAWINGS

A better understanding of the present invention may be had from the following detailed description when read in connection with the accompanying drawings wherein.

DESCRIPTION OF THE PREFERRED EMBODIMENTS

Figure 1:
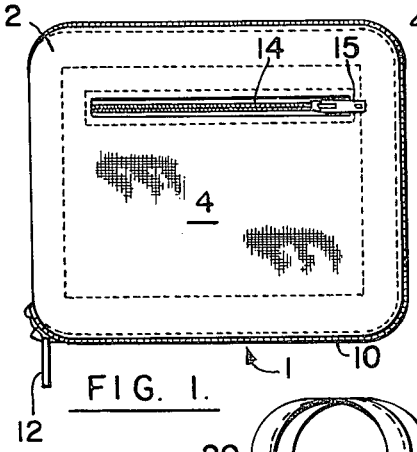
FIG. 1 shows a closed zipper type wallet comprising an embodiment of the present invention.

FIG. 1 shows the device of the present invention in one of the forms in which the invention may be embodied, specifically a combination wallet 1. The wallet 1, shown closed or zipped up in FIG. 1 and opened or unzipped in FIG. 2, comprises a vinyl sheet 2 having two half portions 4 and 6 that are connected together along a central stitched crease line 8. A zipper 10 is attached to the borders of the half portions 4 and 6 of vinyl sheet 2 for connecting or joining the two half portions 4 and 6 together when the said half portions are folded over on the central crease line 8. A tab 12 is provided for opening and closing the zipper 10. A zippered pocket opening 14 is provided on the vinyl half portion 4, as seen in FIG. 1. Desirably, a similar zippered pocket opening 16 is also provided on the other vinyl half portion 6 of the wallet, as may be seen by reference to FIG. 11. Tabs indicated at 15 and 17 are provided for opening and closing the zippered pocket openings 14 and 16, respectively.

Figure 2:
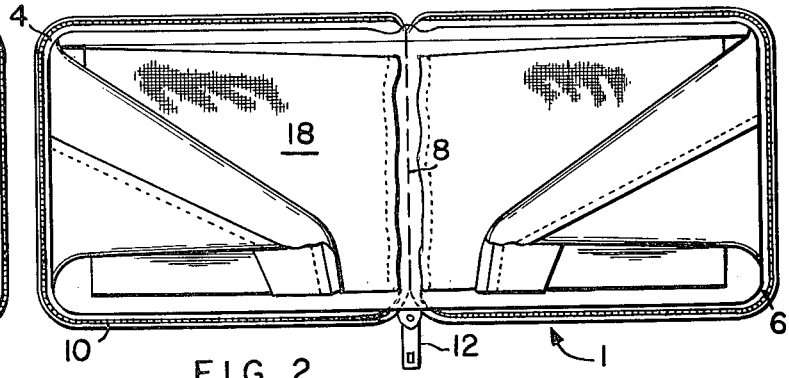
FIG. 2 shows the wallet of FIG. 1 unzipped to reveal the inner fabric bag structure.
Figure 3:
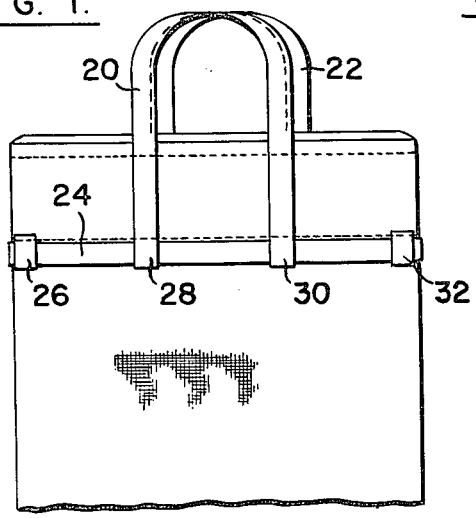
FIG. 3 shows the structure of FIG. 2 opened up and turned inside-out to convert the wallet of FIGS. 1 and 2 into a shopping bag.
Figure 4:
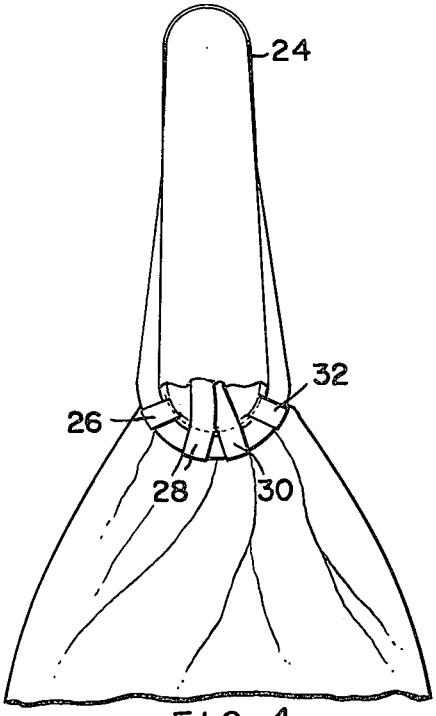
FIG. 4 shows the top portion of the FIG. 3 shopping bag turned inwardly to the level of a shoulder strap, thus converting the shopping bag of FIG. 3 into an over-the-shoulder purse that is shown closed.

In accordance with the invention there is provided within the wallet 1 a nylon, acetate or other suitable fabric bag 18, as is seen in FIG. 2. The bottom of the bag 18 is sewn to the wallet vinyl sheet 2 and has sidewalls extending therefrom. The bag 18 is foldable and containable within the wallet 1 when the latter is zippered along its borders. When the wallet 1 is opened or unzipped, and the bag 18 is turned inside-out, the wallet 1 is convertible into a shopping bag, as is shown in FIG. 3 or into an over-the-shoulder purse, as shown in FIG. 4. The shopping bag of FIG. 3 includes suitable hand straps or handles 20 and 22 for carrying the bag 18. The straps 20 and 22 are sewn to the upper portion of the bag 18 in a manner described further in connection with FIGS. 5, 6 and 7.

Figure 5:
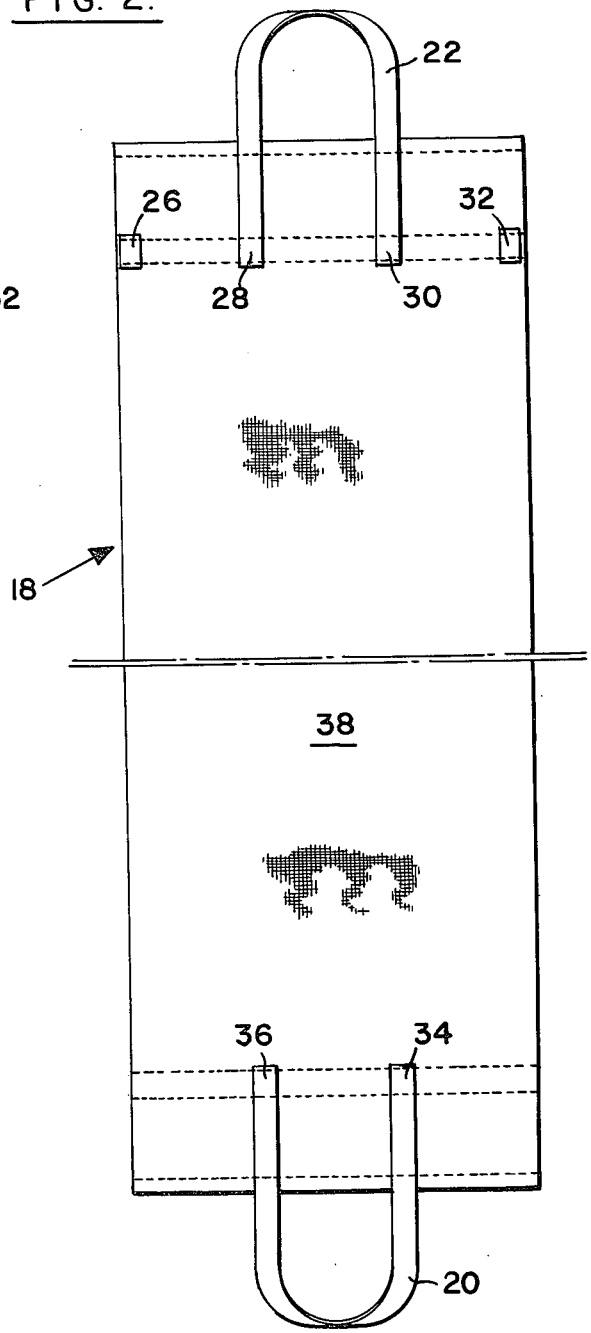
FIG. 5 illustrates the basic fabric sheet or panel from which the bag is made, and shows how straps or handles for the shopping bag of FIG. 3, and loops for suspending the shoulder strap of FIG. 4, are attached to the panel.

The bag 18 also includes a shoulder strap 24 that is suspended from loops 26, 28, 30 and 32, as seen in FIGS. 3 and 4. Additional loops 34 and 36, FIG. 5, are also provided for the shoulder strap 24. These loops 34 and 36 appear on the other side of the bag which is shown in FIG. 3. All of the loops 26-36 are sewn to the outside surface of the bag sidewalls at a selected distance from the top of the bag. As a result, when the top of the bag is folded inwardly down to the level of the shoulder strap 24, and the shoulder strap 24 is pulled away from the sidewalls to collapse the walls, the top of the bag is neatly closed with the elongated portion of the shoulder strap 24 being available for sliding over the shoulder of a person desiring to wear the bag 18, in its thus modified form, as an over-the-shoulder purse.

In the shopping bag form of the invention and also in the over-the-shoulder purse form of the invention, the vinyl sheet 2 of the wallet 1 itself forms an inside, strong, and reinforced bottom of the bag.

In operation, the device of the invention in the form illustrated in FIG. 1 is carried in the pocket of a person and acts as a wallet with its two zippered pockets 14, 16. When the device is to be used as a shopping bag or as an over-the-shoulder purse, the border zipper 10 of the wallet is unzipped, the bag sidewalls are spread upwardly, and the bag is pulled inside-out whereby the vinyl sheet 2 becomes the inside bottom of the bag, and the latter is selectively available for use as a shopping bag or over-the-shoulder purse.

Figure 6:
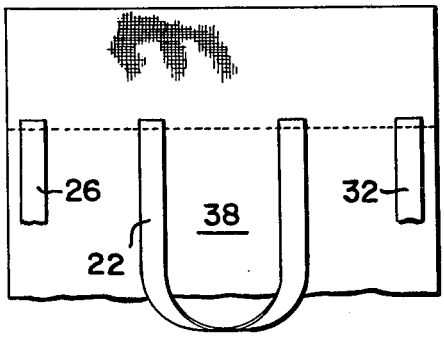
FIGS. 6 and 7 are segmental views illustrating the manner of attachment or stitching of the straps or handles and the shoulder strap suspension loops to the bag.
Figure 7:
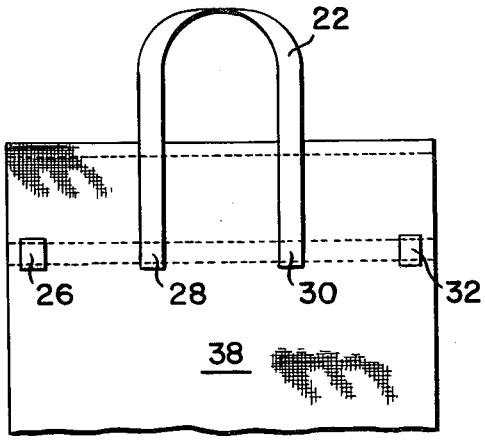
Figure 8:
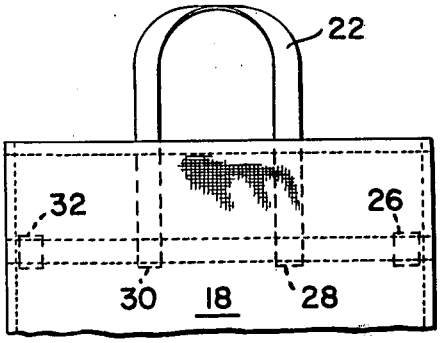
FIG. 8 shows the fabric panel of FIG. 5 folded and the sides stitched to form the bag.

As illustrated in FIG. 5, the nylon or acetate bag 18 is formed from an elongated fabric sheet or panel 38. Prior to being folded upon itself and having its sides stitched together, as illustrated in FIG. 8, the straps 20 and 22 and the loops 26, 28, 30, 32, 34, and 36 are stitched to the panel 38, as indicated in FIG. 5. The manner of stitching the straps 20 and 22 and the loops 26–34 to the panel 38 is illustrated in more detail in FIGS. 6 and 7. Thus, as seen in FIG. 6, one end each of the loops 26 and 32 and the opposite ends of the strap 22 are first stitched to the panel 38 with the material of the loops and the strap 20 hanging downwardly. The loops 26 and 32 are then folded upwardly and inwardly to form the loops, and the strap 22 also is folded upwardly, following which, as seen in FIG. 7, the loops 26 and 32 and the ends of the strap 22 are again stitched to the panel 38. Additionally, the upper end of panel 38 is folded over and stitched to provide a seam for improving the appearance of the bag and to minimize any tendency to fraying, the strap 22 also being further stitched to the panel 38 during such stitching operation.

Similarly, the loops 34 and 36 and the strap 20 are stitched to the panel 38, the adjacent end of the panel 38 also being folded over and stitched to provide a reinforcing seam.

In carrying out the foregoing manufacturing operations, the nylon, acetate or other fabric piece comprising panel 38 is cut out in appropriate width and length. The loop and strap material generally is of common width, and hence, long lengths of such material can be employed and cut in appropriate lengths, as needed. The loops and handles are sewn on the outside of the bag and the end reinforcing seams are sewn on the inside of the bag.

The fabric piece or panel 38 is folded in half with the hand-carry straps and shoulder strap suspension on the inside, as seen by reference to FIG. 8, following which the side seams are sewn. The side seam stitching is not visible when the bag is turned right side out, with the loops and straps on the outside.

Figure 10:
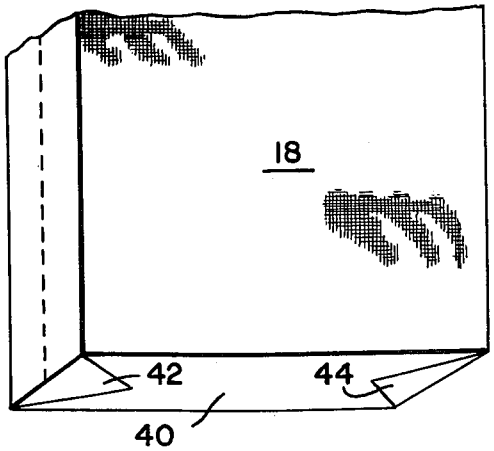
FIGS. 9 and 10 show how the bottom of the bag is formed and sewed.
Figure 9:
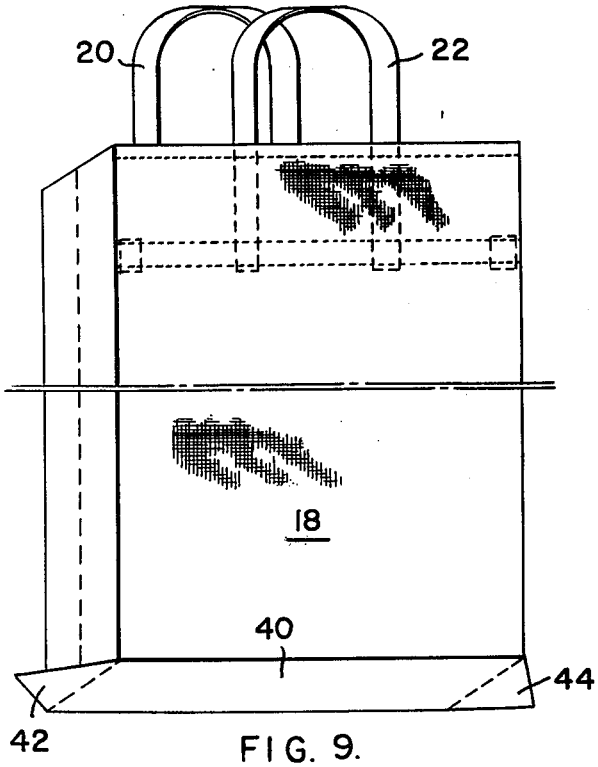
Figure 11:
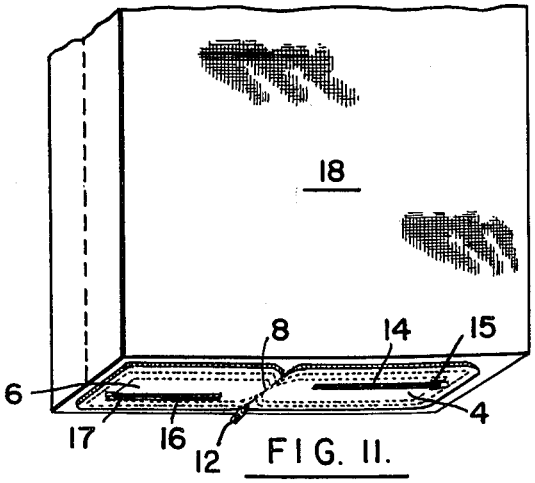
FIG. 11 is a segmental view showing how the bottom of the bag is sewed to the inside of the wallet.
Figure 12:
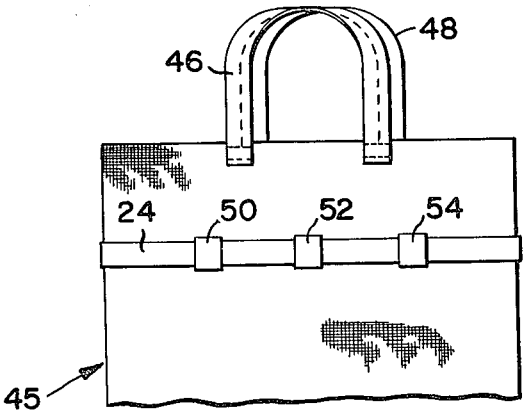
FIGS. 12–16 are views illustrating another embodiment of the invention.

By reference to FIGS. 9, 10 and 11, it is seen that the bottom of the bag resulting from the stitching operation performed as described in connection with FIG. 8, is stitched to form a rectangular base 40 of a size generally corresponding to the dimensions of the vinyl sheet portions 4 and 6, as seen in FIG. 2. The resulting triangular ears 42 and 44 are folded over, as seen in FIG. 10, following which the vinyl sheet half portions 4 and 6 are attached to the rectangular base 40 by sewing, with the inside of the vinyl sheet portions adjacent to the base 40.

Thus, the nylon, acetate or other fabric bag bottom forms the interior of the wallet pocket. The wallet itself forms an inside, strong, and reinforced bottom of the bag.

In operation, the device is carried in the pocket and comprises a wallet having two zippered pockets 14 and 16. When the device is to be used as a shopping bag or purse, the border zipper 10 of the wallet is unzipped, the nylon or acetate fabric sidewalls are spread outwardly, and the bag is pulled inside-out so that the wallet becomes the inside bottom of the bag.

There is illustrated in FIGS. 12–16 another embodiment of the invention, a combined bag 45 wherein hand straps 46 and 48 for carrying the shopping bag are attached in a different manner to the bag 45. The manner of attachment of the shoulder strap 24 to the bag 45 is generally similar to that illustrated and described in connection with bag 1 of FIGS. 3–7 and includes an appropriate number of loops, several being indicated at 50, 52 and 54, for suspending the strap 24.

Figure 13:
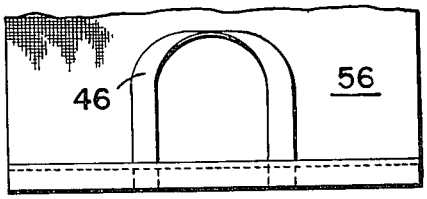
Figure 14:
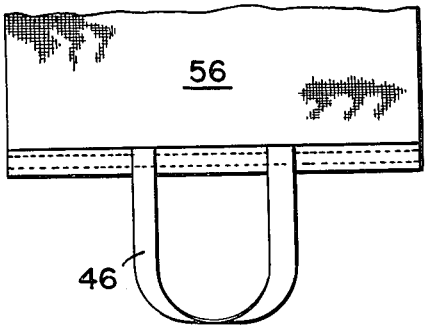

Prior to sewing the side seams of a folded sheet or panel 56 that may be similar to the panel 38, to form the bag 45 of FIGS. 12–16, the straps 46 and 48 are sewn to the opposite ends of panel 56. Specifically, by reference to FIG. 13, hand strap 46 is positioned adjacent the inside surface of the bag, with the hand strap 46 facing inwardly of the panel 56 and with the ends of the strap 46 between the panel 56 and the folded over end or edge of the panel forming a seam. The seam is then stitched, as indicated in FIG. 13. The hand strap 46 then is folded outwardly away from the panel 56, following which the seam and strap 46 are again stitched, as indicated in FIG. 14.

Figure 15:
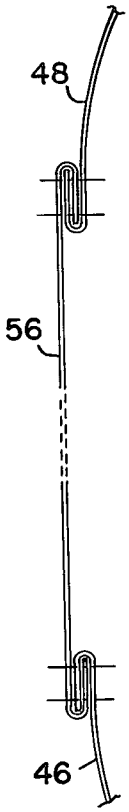

The hand strap 48 is similarly attached to the other end of the panel 56 and a seam also is similarly formed at that end of the panel 56, as is indicated in FIG. 15.

Figure 16:
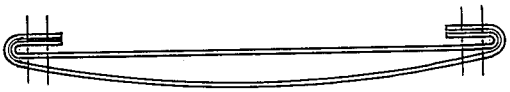

In order to strengthen the seams provided at the sides of the bag, the side edges of the panel are doubled over and two rows of stitches are provided, as indicated in FIG. 16.

Figure 17:
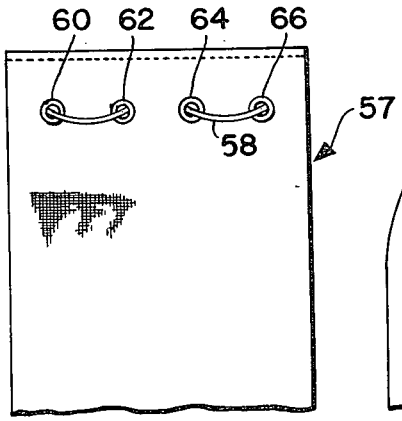
FIGS. 17–19 are views illustrating a further embodiment of the invention.
Figure 18:
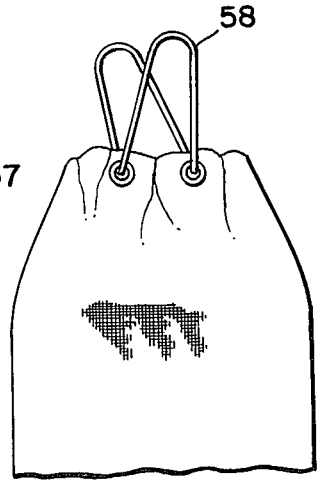
Figure 19:
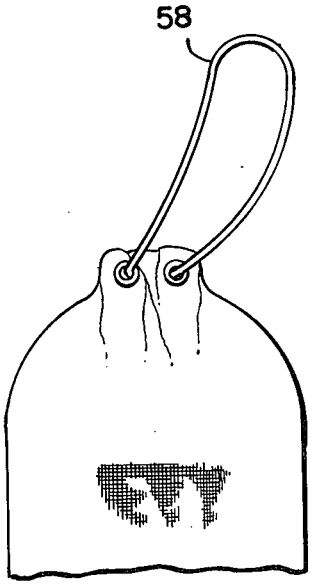

In the further embodiment 57 of the invention illustrated in FIGS. 17, 18 and 19, separate hand-carry and shoulder straps have been dispensed with, and in lieu thereof, a suitably heavy cord 58 is interlaced in a number of eyelets 60, 62, 64 and 66 disposed adjacent the top of the bag. Desirably, the eyelets are reinforced with a ring of durable material such as metal. In this modification the bag 57 is closed by pulling the cord 58 to collapse the opening at the top of the bag. The cord 58 may be pulled substantially evenly through the eyelets 60–66 at opposite sides of the bag to provide a convenient hand-carry strap, as indicated in FIG. 18. Alternatively, the cord 58 may be pulled through the eyelets 60–66 at one side of the bag only whereby an elongated strap is formed to permit over-the-shoulder carry of the bag. As in the other embodiments described, the arrangement is such that when the device is to be used as an over-the-shoulder purse, the upper portion of the bag may be folded inwardly to the level of the suspension of cord 58 whereby pulling of the cord 58 causes the top of the bag to be neatly closed.

Thus, there has been provided in accordance with the present invention a combined wallet, shopping bag, and over-the-shoulder purse for carrying, while traveling, miscellaneous articles, for example, personal belongings such as photographs, shopping purchases, cards, keys and money.

I claim:

1. A combined wallet, shopping bag, and over-the-shoulder purse comprising a sheet having two half portions connected together along a central crease line, closure means operative when said two half portions of said sheet are folded over on said central crease line to hold said half portions together, a pocket opening in at least one of said half portions of said sheet, a foldable cloth bag having a bottom sewn to said sheet with said sidewalls extending substantially from the edges of said sheet, foldable strap means for carrying said container, said strap means having attachments to the sidewalls of said bag at positions remote from the bag portion attached to said sheet, said bag being foldable and containable within the confines of said sheet when said two half portions are folded over and held together, and said sheet forming the bottom portion of the bag when the bag is opened into operative position.

2. A container as specified in claim 1 including a pocket opening in each of said half portions of said sheet.

3. A container as specified in claim 1 wherein said foldable strap means includes a pair of hand straps and a shoulder strap, said hand strap or shoulder strap being selectively useful for carrying said container.

4. A container as specified in claim 3 wherein the ends of said pair of hand straps are attached to the top edge of said bag.

5. A container as specified in claim 1 wherein said foldable strap means includes a shoulder belt loop suspended from the sidewalls of said bag, the positions of attachment of said belt loop to the sidewalls of said bag being such as to allow a top portion of the bag to be folded inwardly to the level of said belt loop whereby pulling said belt loop collapses the said sidewalls to close the top of the bag, the open end of said belt loop being slidable over a person's shoulder.

6. A container as specified in claim 5 wherein said shoulder belt loop comprises an endless strap suspended by loops sewn to the sidewalls of said bag.

7. A container as specified in claim 6 wherein said foldable strap means further includes a pair of straps for hand carrying said bag, the ends of each of said straps being sewn to the sidewalls of said bag to provide a loop from which said shoulder strap is suspended.

8. A container as specified in claim 5 wherein eyelets are provided in the sidewalls of said bag and said shoulder belt loop comprises a cord interlaced in said eyelets.

9. A container as specified in claim 1 wherein said cloth bag is formed from a single cloth panel that is folded over along a center line, having side seams sewn, and the bottom corners sewn to provide a generally rectangular bottom of approximately the same size and shape as said vinyl sheet.

10. The combined wallet, shopping bag, and over-the-shoulder purse for carrying while traveling miscellaneous articles such as personal belongings, of claim 1, including said sheet being made of vinyl plastic, said closure means being a zipper along the borders of the half portions of said vinyl sheet for connecting the two half portions together when folded over on the central crease line, said pocket opening in each half portion being zippered, said bag being of nylon, and said foldable strap means includes a pair of hand straps and a shoulder strap, said hand straps and said shoulder strap being selectively useful for carrying said container, wherein the ends of said hand straps are attached to said bag adjacent the top edge thereof, wherein said shoulder strap comprises an endless strap suspended by loops from the sidewalls of said bag, the positions of attachment of said shoulder strap to the sidewalls of said bag being such as to allow a top portion of the bag to be folded inwardly to the level of said shoulder strap whereby pulling said shoulder strap collapses the said sidewalls to close the bag, the open end of said shoulder strap being slidable over a person's shoulder, and wherein said nylon bag is formed from a single panel that is folded over along a center line, having side seams sewn, and the bottom corners sewn to provide a generally rectangular bottom of approximately the size and shape as said vinyl plastic sheet.

* * * * *